US005507398A

United States Patent [19]

Miller

[11] Patent Number: 5,507,398

[45] Date of Patent: Apr. 16, 1996

[54] OVEN RACKS WITH FOUR INDEPENDENTLY ADJUSTABLE STANDOFFS AT THE CORNERS THEREOF

[76] Inventor: Barbara J. Miller, 3515 Sargeant Dr., Charlotte, N.C. 28217

[21] Appl. No.: 235,906

[22] Filed: May 2, 1994

[51] Int. Cl.[6] ..... A47F 5/08

[52] U.S. Cl. ..... 211/153; 248/188.9; 312/410

[58] Field of Search ..... 211/153, 181, 211/134; 248/188.9, 188.4, 650, 242, 243; 312/408, 410, 351

[56] References Cited

U.S. PATENT DOCUMENTS

| | | | |
|---|---|---|---|
| 269,365 | 12/1882 | Wood | 248/188.4 |
| 972,287 | 10/1910 | Swift | 248/188.4 |
| 2,097,349 | 10/1937 | Sladek | 248/188.4 X |
| 2,634,867 | 4/1953 | Shields | 211/153 |

*Primary Examiner*—Alvin C. Chin-Shue

*Assistant Examiner*—Korie H. Chan

[57] ABSTRACT

An oven rack with four independently adjustable standoffs at the corners thereof comprising an oven rack in a rectangular configuration having an enlarged wire shaped in a rectangular configuration to constitute the periphery of the rack; a plurality of smaller wires in a horizontal array extending longitudinally and laterally with respect to the periphery of the rack within the interior peripheral surface of the enlarged wire; a foot adjustably secured with respect to the enlarged wire at the four corners thereof and extendable downwardly to a predetermined distance, each foot having a lower planar surface of a circular configuration with an enlarged diameter and an upstanding cylindrical member; and an upwardly extending recess within each of the four corners of the enlarged wire to slidably receive the cylindrical member of the foot whereby rotation of the foot with respect to the enlarged wire and rack will allow for the raising or lowering of the lower surface of the foot thereby permitting the adjustment thereof.

1 Claim, 2 Drawing Sheets

OVEN RACKS WITH FOUR INDEPENDENTLY ADJUSTABLE STANDOFFS AT THE CORNERS THEREOF

BACKGROUND OF THE INVENTION

1. Field of the Invention

The present invention relates to a new and improved oven rack with four independently adjustable standoffs at the corners thereof and, more particularly, pertains to adjusting oven racks to maintain their horizontal dispositions.

2. Description of the Prior Art

The use of oven racks and adjustment mechanisms is known in the prior art. More specifically, oven racks and adjustment mechanisms heretofore devised and utilized for the purpose of adjusting mechanisms to insure the proper positioning of objects are known to consist basically of familiar, expected, and obvious structural configurations, notwithstanding the myriad of designs encompassed by the crowded prior art which has been developed for the fulfillment of countless objectives and requirements.

The prior art discloses a large number of oven racks and adjustment mechanisms. By way of example, U.S. Pat. No. 3,454,744 to Vonderhaar discloses an oven rack system.

U.S. Pat. No. 3,954,053 to Johansson discloses a rack oven.

U.S. Pat. Nos. 4,048,984 to Eberhardt and 4,051,838 to Pinckney disclose oven racks.

Lastly, U.S. Pat. No. Des. 251,106 to Petursson discloses an ornamental design for an oven rack.

In this respect, the oven rack with four independently adjustable standoffs at the corners thereof according to the present invention substantially departs from the conventional concepts and designs of the prior art, and in doing so provides an apparatus primarily developed for the purpose of adjusting oven racks to maintain their horizontal dispositions.

Therefore, it can be appreciated that there exists a continuing need for a new and improved oven rack with four independently adjustable standoffs at the corners thereof which can be used for adjusting oven racks to maintain their horizontal dispositions. In this regard, the present invention substantially fulfills this need.

SUMMARY OF THE INVENTION

In view of the foregoing disadvantages inherent in the known types of oven racks and adjustment mechanisms now present in the prior art, the present invention provides a new and improved oven rack with four independently adjustable standoffs at the corners thereof. As such, the general purpose of the present invention, which will be described subsequently in greater detail, is to provide a new and improved oven rack with four independently adjustable standoffs at the corners thereof and methods which have all the advantages of the prior art and none of the disadvantages.

To attain this, the present invention essentially comprises a new and improved oven rack with four independently adjustable standoffs at the corners thereof comprising, in combination, an oven rack in a rectangular configuration having an enlarged wire shaped in a rectangular configuration to constitute the periphery of the rack; a plurality of smaller wires in a horizontal array extending longitudinally and laterally with respect to the periphery of the rack within the interior peripheral surface of the enlarged wire; a foot adjustably secured with respect to the enlarged wire at the four corners thereof and extendable downwardly to a predetermined distance, each foot having a lower planar surface of a circular configuration with an enlarged diameter and an upstanding cylindrical member of a reduced diameter, the cylindrical member having a cylindrical exterior surface of a first diameter less than the diameter of the foot and having an interior diameter less than the exterior diameter, the interior diameter being formed as a downwardly extending aperture with interiorly facing screw threads; and an upwardly extending recess within each of the four corners of the enlarged wire, each recess having a cylindrical exterior surface extending upwardly from the bottom of the enlarged wire to a distance short of the top of the enlarged wire, the exterior surface being smooth with a diameter adapted to slidably receive the cylindrical member of the foot, the recess also having a downwardly extending projection formed with externally extending threads with a diameter essentially equal to the interior diameter of the foot, whereby when the cylindrical member of the foot is threadedly secured onto the exterior threads depending from the projection of the enlarged wire, rotation of the foot with respect to the enlarged wire and rack will allow for the raising or lowering of the lower surface of the foot thereby permitting the adjustment thereof.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved oven rack with four independently adjustable standoffs at the corners thereof which has all the advantages of the prior art oven racks and adjustment mechanisms and none of the disadvantages.

It is another object of the present invention to provide a new and improved oven rack with four independently adjustable standoffs at the corners thereof which may be easily and efficiently manufactured and marketed.

It is a further object of the present invention to provide a new and improved oven rack with four independently adjustable standoffs at the corners thereof which is of a durable and reliable construction.

An even further object of the present invention is to provide a new and improved oven rack with four independently adjustable standoffs at the corners thereof which are susceptible of a low cost of manufacture with regard to both materials and labor, and which accordingly are then susceptible of low prices of sale to the consuming public, thereby making such oven rack with four independently adjustable standoffs at the corners thereof economically available to the buying public.

Still yet another object of the present invention is to provide a new and improved oven rack with four independently adjustable standoffs at the corners thereof which provides in the apparatuses and methods of the prior art some of the advantages thereof, while simultaneously overcoming some of the disadvantages normally associated therewith.

Even still another object of the present invention is to adjust oven racks to maintain their horizontal dispositions.

Lastly, it is an object of the present invention to provide an oven rack with four independently adjustable standoffs at the corners thereof comprising an oven rack in a rectangular configuration having an enlarged wire shaped in a rectangular configuration to constitute the periphery of the rack; a plurality of smaller wires in a horizontal array extending longitudinally and laterally with respect to the periphery of the rack within the interior peripheral surface of the enlarged wire; a foot adjustably secured with respect to the enlarged wire at the four corners thereof and extendable downwardly to a predetermined distance, each foot having a lower planar surface of a circular configuration with an enlarged diameter and an upstanding cylindrical member; and an upwardly extending recess within each of the four corners of the enlarged wire to slidably receive the culindrical member of the foot whereby rotation of the foot with respect to the enlarged wire and rack will allow for the raising or lowering of the lower surface of the foot thereby permitting the adjustment thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
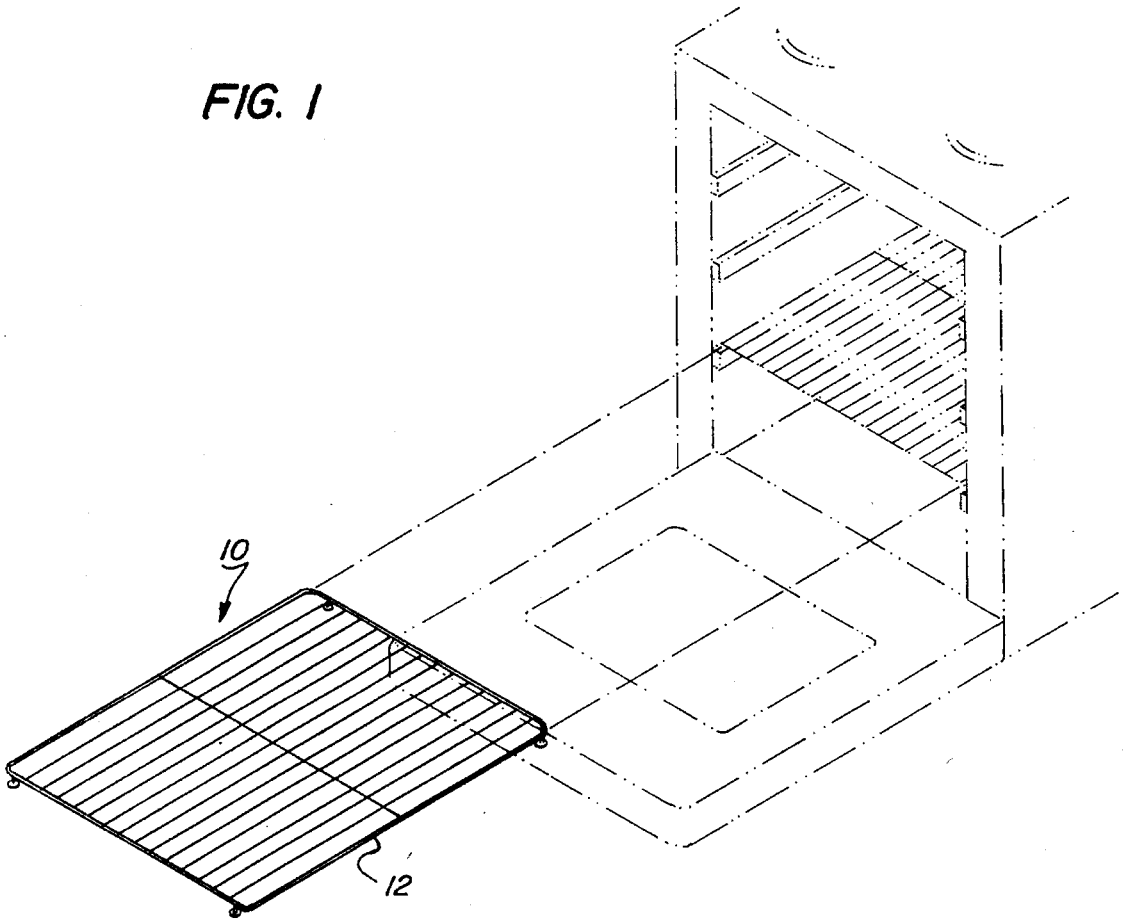
FIG. 1 is a perspective illustration of the preferred embodiment of the new and improved oven rack with four independently adjustable standoffs at the corners thereof constructed in accordance with the principles of the present invention.
Figure 2:
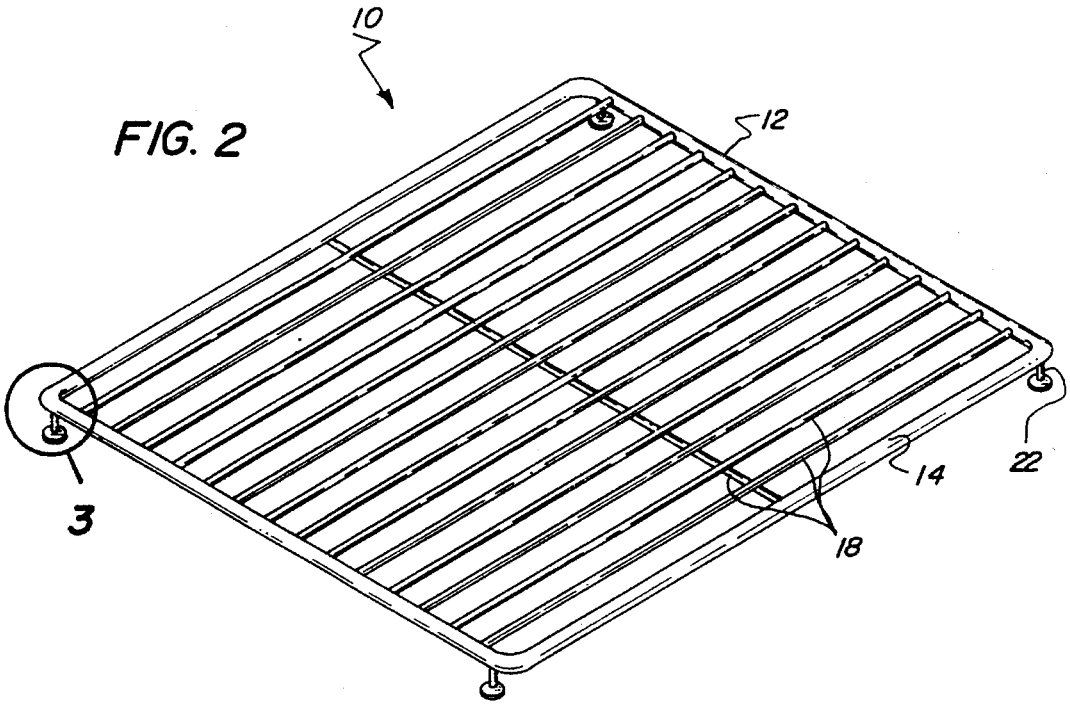
FIG. 2 is an enlarged perspective illustration of the oven rack shown in FIG. 1.
Figure 3:
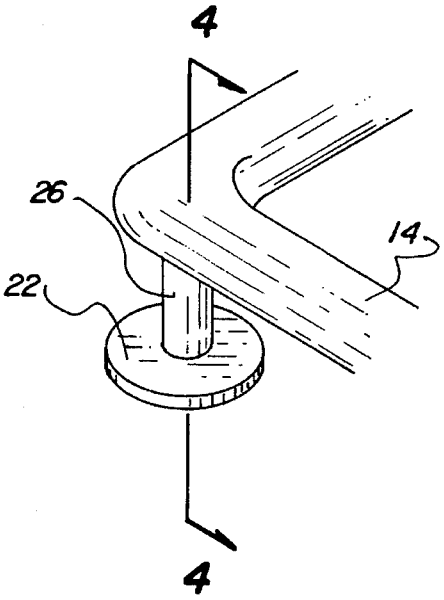
FIG. 3 is an enlarged perspective view of one corner of the oven rack shown in FIG. 2 taken about circle 3 of FIG. 2.
Figure 4:
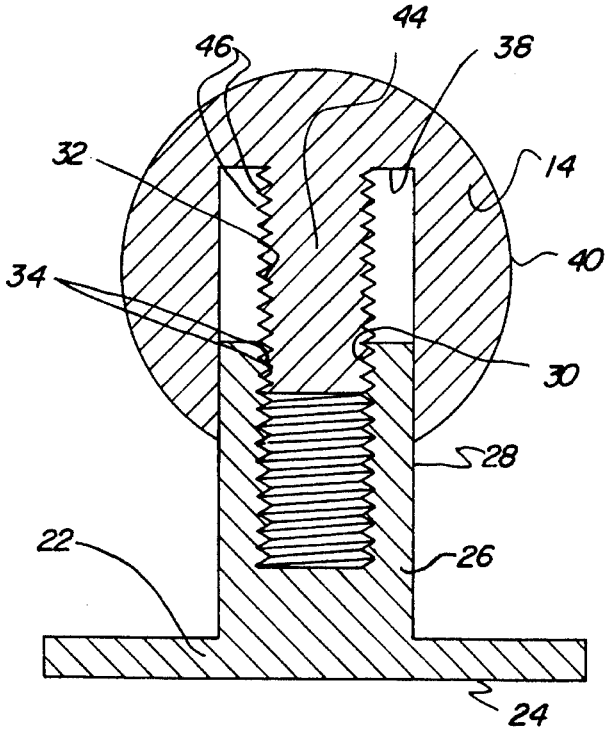
FIG. 4 is a cross-sectional view of the corner of the oven rack taken along line 4—4 of FIG. 3, The same reference numerals refer to the same parts throughout the various Figures.

With reference now to the drawings, and in particular to FIG. 1 the preferred embodiment of the new and improved oven rack with four independently adjustable standoffs at the corners thereof embodying the principles and concepts of the present invention and generally designated by the reference numeral 10 will be described.

The present invention, the new and improved oven rack with four independently adjustable standoffs at the corners thereof is a system comprised of a plurality of components. Such components, in their broadest context, include an oven rack with an enlarged peripheral wire and smaller wires, a foot at each corner with an upstanding cylindrical member, and an upwardly extending recess within each of the four corners of the enlarged wire. Such individual components are specifically configured and correlated one with respect to the other so as to attain the desired objectives.

More specifically, the central component of the present invention is an oven rack 12. At an initial glance it appears to be of a conventional construction in a rectangular configuration. It has an enlarged wire 14 shaped in a rectangular configuration. Such enlarged wire constitutes the periphery of the rack 12.

Also as part of the rack are a plurality of smaller wires 18 in a horizontal array extending longitudinally and laterally with respect to the periphery of the rack. Such smaller wires are located within the interior peripheral surface of the enlarged wire.

Located at each corner of the rack is a foot 22. Each foot foot is adjustably secured with respect to the enlarged wire at the four corners of the rack. Each foot extends downwardly from the rack to a predetermined distance. Each foot has a lower planar surface 24 of a circular configuration. It is of an enlarged diameter. It also includes an upstanding cylindrical member 26 of a reduced diameter. The cylindrical member has a cylindrical exterior surface 28 of a first diameter less than the diameter of the foot. It also has an interior diameter 30 less than the exterior diameter. The interior diameter is formed as a downwardly extending aperture 32 with interiorly facing screw threads 34.

Lastly provided is an upwardly extending recess 38 within each of the four corners of the enlarged wire of the rack. Each recess is similarly configured to have a cylindrical exterior surface 40. Such surface extends upwardly from the bottom of the enlarged wire to a distance short of the top of the enlarged wire. The exterior surface is smooth with a diameter adapted to slidably receive the cylindrical member of the foot.

The recess also has a downwardly extending projection 44. The projection formed with externally extending screw threads 46. The screw threads have a diameter essentially equal to the interior diameter of the foot. In this manner, when the cylindrical member of the foot is threadedly secured to the exterior threads depending from the projection of the enlarged wire, rotation of the foot with respect to the enlarged wire and rack will cause an axial movement of the foot with respect to the rack. This will allow for the raising or lowering of the lower surface of the foot independent of the other feet. As a result, adjustment of the rack is possible to maintain the horizontal disposition thereof when placed on a recipient surface.

The installation of many home appliances requires a stable, level supporting surface. Ovens, refrigerators, washers and dryers all need to be level for their proper operation. Ovens, for example, must be level to allow food to cook without moving to one side of the pan or spilling. But ovens are usually not equipped with legs that are easily adjusted by the owner. What is needed is a rack within the oven that can be adjusted to fulfill this need. The present invention utilizes small, adjustable standoffs under its four supporting corners to allow anything placed on it to be leveled on any axis.

The present invention is constructed of metal in a manner very similar to ordinary racks, but it has four independently adjustable standoffs, one at each corner. The standoffs are threaded, and can raise or lower the rack to any degree within their range of movement. To use the present invention, it is placed in the oven on the existing supports. The position of the rack can be determined by using a shallow pan with a small amount of water in it. If the water settles on the forward edge of the pan, then the forward two standoffs can be raised to compensate for the uneven angle.

The present invention is easily installed and adjusted. It can be sized to suit the needs of almost any oven design. Once the ideal angle is set, it should not have to be readjusted. The advantage of installing the present invention is clear; it helps to prepare foods such as cakes and pies that are very sensitive to slight differences in the angle of the baking rack.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved oven rack with four independently adjustable standoffs at the corners thereof comprising, in combination:

an oven rack in a rectangular configuration having an enlarged wire shaped in a rectangular configuration to constitute the periphery of the rack, the wire being continuous and rigid in form;

a plurality of smaller wires in a horizontal array extending longitudinally and laterally with respect to the periphery of the rack within the interior peripheral surface of the enlarged wire;

a foot adjustably secured with respect to the enlarged wire at the four corners thereof and extendable downwardly to a predetermined distance, each foot having a lower planar surface of a circular configuration with an enlarged diameter and an upstanding cylindrical member of a reduced diameter, the cylindrical member having a cylindrical exterior surface of a first diameter less than the diameter of the foot and having an interior diameter less than the exterior diameter, the interior diameter being formed as a downwardly extending aperture with interiorly facing screw threads; and an upwardly extending recess within each of the four corners of the enlarged wire, each recess having a cylindrical exterior surface extending upwardly from the bottom of the enlarged wire to a distance short of the top of the enlarged wire, the exterior surface being smooth with a diameter adapted to slidably receive the cylindrical member of the foot, the recess also having downwardly extending projection formed with externally extending threads with a diameter essentially equal to the interior diameter of the foot, whereby when the cylindrical member of the foot is threadedly secured onto the exterior threads depending from the projection of the enlarged wire, rotation of the foot with respect to the enlarged wire causes axial movement of the foot with respect to the rack and will allow for the raising or lowering of the lower surface of each foot independent of the other feet thereby permitting the adjustment thereof, each foot being rotated with respect to the enlarged wire and positioned on a recipient surface being capable of positioning the rack, when placed within an oven, within alternate horizontal plans, the rack being adjusted by rotation of each foot allowing for proper baking of position sensitive foods.

* * * * *